US006533482B1

(12) United States Patent
Byun

(10) Patent No.: US 6,533,482 B1
(45) Date of Patent: Mar. 18, 2003

(54) COSMETIC ARTICLE HAVING IMPROVED DISPENSING STRUCTURE

(76) Inventor: Young Kwang Byun, Apt. 928-1005, 312, Shinjung-dong, Yangchun-gu, Seoul (KR)

( * ) Notice: Subject to any disclaimer, the term of this patent is extended or adjusted under 35 U.S.C. 154(b) by 0 days.

(21) Appl. No.: 10/072,242

(22) Filed: Feb. 6, 2002

(30) Foreign Application Priority Data

Dec. 14, 2001 (KR) ..... 2001-38689

(51) Int. Cl.[7] ..... B43K 5/06

(52) U.S. Cl. ..... 401/180; 401/149; 401/151; 401/176; 401/178; 401/188 R; 401/209; 401/265; 401/278; 401/279; 401/284; 401/286; 222/321.7; 222/341; 222/386; 222/387

(58) Field of Search ..... 401/37–39, 120, 401/136, 149–151, 171, 176–180, 182, 187–188 A, 209, 262, 265, 266, 268, 269, 270, 272, 273, 278, 279, 282–286, 288, 289; 222/321.7, 341, 386–387, 582, 585, 587

(56) References Cited

U.S. PATENT DOCUMENTS 3,682,559 A * 8/1972 Hirota ..... 401/278
4,830,284 A * 5/1989 Maerte ..... 222/321.6
4,976,563 A * 12/1990 Iizuka et al. ..... 401/176
5,092,702 A * 3/1992 Kurokawa ..... 401/279
5,271,532 A * 12/1993 Jumel et al. ..... 222/385

* cited by examiner

*Primary Examiner*—Gregory L. Huson
*Assistant Examiner*—Tuan Nguyen
(74) *Attorney, Agent, or Firm*—Irving M. Weiner; Pamela S. Burt; Weiner & Burt, P.C.

(57) ABSTRACT

Disclosed is a cosmetic article having an improved dispensing structure, which compactly combines liquid cosmetic product with an applicator used for applying the liquid cosmetic product. The cosmetic article includes a housing being in the form of a case opened at both ends and filled with liquid cosmetic product, an applicator disposed at a front end of the housing to apply the liquid cosmetic product, and a dispensing member disposed as a rear end of the housing to dispense the liquid cosmetic product to the applicator, wherein she dispensing member includes: a filling and dispensing part having an inner case being in the form of a case opened at both ends, containing the liquid cosmetic products therein and inserted into the housing in a reciprocating manner, an end cap connected to an opened rear end of the inner case, a fixed valve disposed at an opened front end of the inner case, an actuating valve disposed inside the fixed valve in a reciprocating manner, a spring elastically supporting the actuating valve to be reciprocated inside he fixed valve, and an opening cap for mounting the actuating valve and the fixed valve at the opened front end of the inner case; and a pressurizing part having a rear end cap disposed at the rear end of the housing, a button disposed at a central portion of the rear end cap in a reciprocating manner, and a spring interposed between the button and the end cap.

10 Claims, 12 Drawing Sheets

COSMETIC ARTICLE HAVING IMPROVED DISPENSING STRUCTURE

BACKGROUND OF THE INVENTION

1. Field of the Invention

The present invention relates to a cosmetic article having an improved dispensing structure, and more particularly, to a cosmetic article having an improved dispensing structure, which compactly combines liquid cosmetic product, such as liquid type foundation and lip gloss, with an applicator used for applying the liquid cosmetic product, and particularly, which improves its dispensing structure to make the liquid cosmetic product contained in a housing be dispensed even and smooth.

2. Background of the Related Art

Cosmetic articles filled with liquid cosmetic product, which is combined with an applicator, are disclosed in U.S. patent application Ser. Nos. 09/850,868 and 09/938,124 filed by the same applicant as The present invention. Particularly, the dispensing structure for dispensing foundation contained in a housing to the outside, which is disclosed in U.S. patent application Ser. No. 09/850,868, includes a discharge valve for giving a discharge path of the foundation and a pressurizing pump for pumping the foundation. The dispensing structure disclosed in U.S. patent application Ser. No. 09/938,124 includes a pressurizing pump for reciprocating a slide an, an induction pipe for moving the foundation by pressure of the slide pin and a dispensing nozzle for discharging the foundation by opening and closing a liquid path through operation of the induction pipe.

However, the two prior arts have a separate structure that an inner housing containing the liquid cosmetic product therein and a dispensing member for dispensing the liquid cosmetic are independent components and are connected to each other in structure. Therefore, the prior arts have several problems that it is difficult to reduce a manufacturing cost because lots of components are required and that it is difficult to reduce an error rate less than a predetermined level because a special sealing is needed in housing that the independent components are connected to each other in structure.

SUMMARY OF THE INVENTION

Accordingly, the present invention is directed to a cosmetic article having an improved dispensing structure that substantially obviates one or more problems due to limitations and disadvantages of the related art.

An object of the present invention is to provide a cosmetic article having an improved dispensing structure capable of making the dispensation of liquid cosmetic product in a housing ever and smooth, giving a reliable sealing by reducing the number of components, and reducing a manufacturing cost.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a cosmetic article having an improved dispensing structure includes a housing being in the form of a case opened at both ends and filled with liquid cosmetic product, a front end part disposed at a front end of the housing to apply the liquid cosmetic product discharged from the housing, and a dispensing member disposed at a rear end of the housing to dispense the liquid cosmetic product to the front end part, wherein the dispensing member includes: a filling and dispensing part having an inner case being in the form of a case opened at both ends, containing the liquid cosmetic products therein and inserted into the housing in a reciprocating manner, an end cap connected to an opened rear end of the inner case, a fixed valve disposed at an opened front end of the inner case, an actuating valve disposed inside the fixed valve in a reciprocating manner, a spring elastically supporting the actuating valve to be reciprocated inside the fixed valve, and an opening cap for mounting the actuating valve and the fixed valve at the opened front end of the inner case; and a pressurizing part having a rear end cap disposed at the rear end of the housing, a button disposed at a central portion of the rear end cap in a reciprocating manner, and a spring interposed between the button and he end cap.

The fixed valve includes: a fixed valve pipe perforated at a central portion thereof and fixed at the front end of tie inner case; an opening hole located at the perforated center of the fixed valve pipe to discharge and block the liquid cosmetic product inside the inner case; and a spring elastically supporting the opening hole in a rear end direction of the inner case.

The actuating valve includes: an actuating valve pipe perforated at a central portion thereof and disposed inside the fixed valve in a reciprocating manner; an opening hole located at the perforated center of the actuating valve pipe to discharge and block the liquid cosmetic product inside the fixed valve; and a spring elastically supporting the opening hole in a front end direction of the inner case.

The end cap includes an end hole perforating a central portion thereof and the inner case includes a movable member mounted therein and elevated according to pressure of the inner case.

The opening cap is screwed to the front end of the inner case to inject the liquid cosmetic product into the inner case at any time.

The front end part includes: a ball rotated due to friction with the outside; and a front end cap for mounting the ball at the front end of the housing, the front end cap communicating with the actuating valve to dispense the liquid cosmetic product through the ball.

The front end part includes: a brush consisting of a bunch of cilia; and a front end cap for mounting the brush at the front end of the housing, the front end cap communicating with the actuating valve to dispense the liquid cosmetic product to the brush.

The front end part includes: a brush formed by coating villosity on the outside of solid villi; and a front end cap for mounting the brush at the front end of the housing, the front end cap communicating with the actuating valve to dispense the liquid cosmetic product to the brush.

the front end part includes: a fixed brush consisting of a bunch of cilia; a front end outer body mounting the brush to the front end of the housing and having a projection formed on an outer periphery thereof; a front end body inserted inside the front end outer body to fix the brush to an end of the front end outer body, the front end body communicating with the actuating valve to discharge the liquid cosmetic product to the brush; an elevation holder having a spiral hole formed on an inner periphery thereof, a projection formed on an outer periphery thereof and an actuating brush disposed at a front end thereof, the spiral hole being engaged with the projection of he front end outer body; and a front end cap having a straight hole formed on an inner periphery thereof for engaging the projection of the elevation holder, the front end cap being rotatably connected to the outer periphery of the front end outer body.

The front end part includes: a ball rotated due to friction with the outside; a front end outer body rotatably mounting the ball to the front end of the housing and having a projection formed on an outer periphery thereof; a front end body inserted inside the front end outer body to fix the brush to an end of the front end outer body, the front end body communicating with the actuating valve to discharge the liquid cosmetic product to the brush; an elevation holder having a spiral hole formed on an inner periphery thereof, a projection formed on an outer periphery thereof and an actuating brush disposed at a front end thereof, the spiral hole being engaged with the projection of the front end outer body; and a front end cap having a straight hole formed on an inner periphery thereof for engaging the projection of the elevation holder, the front end cap being rotatably connected to the outer periphery of the front end outer body It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
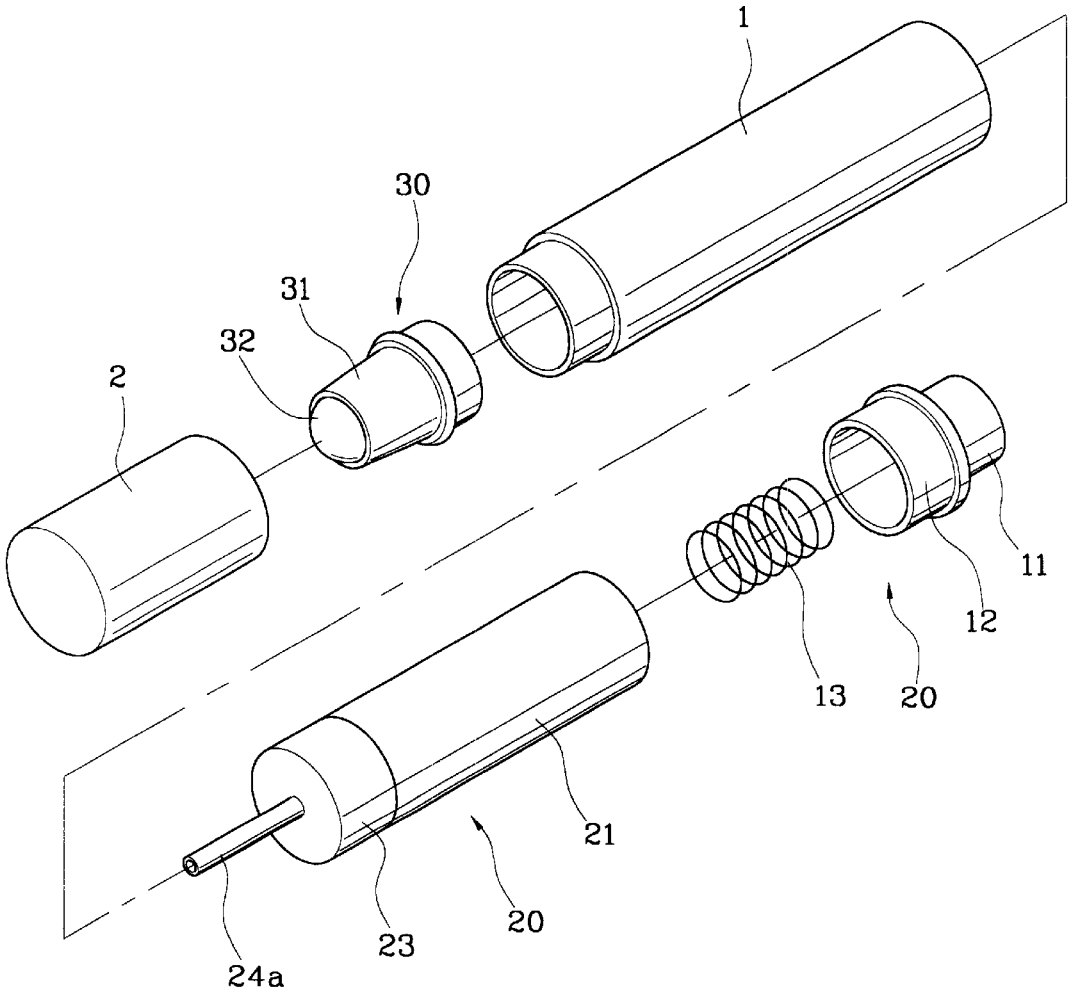
FIG. 1 illustrates an exploded perspective view of a cosmetic article having an improved dispensing structure according to a first preferred embodiment of the present invention.
Figure 2:
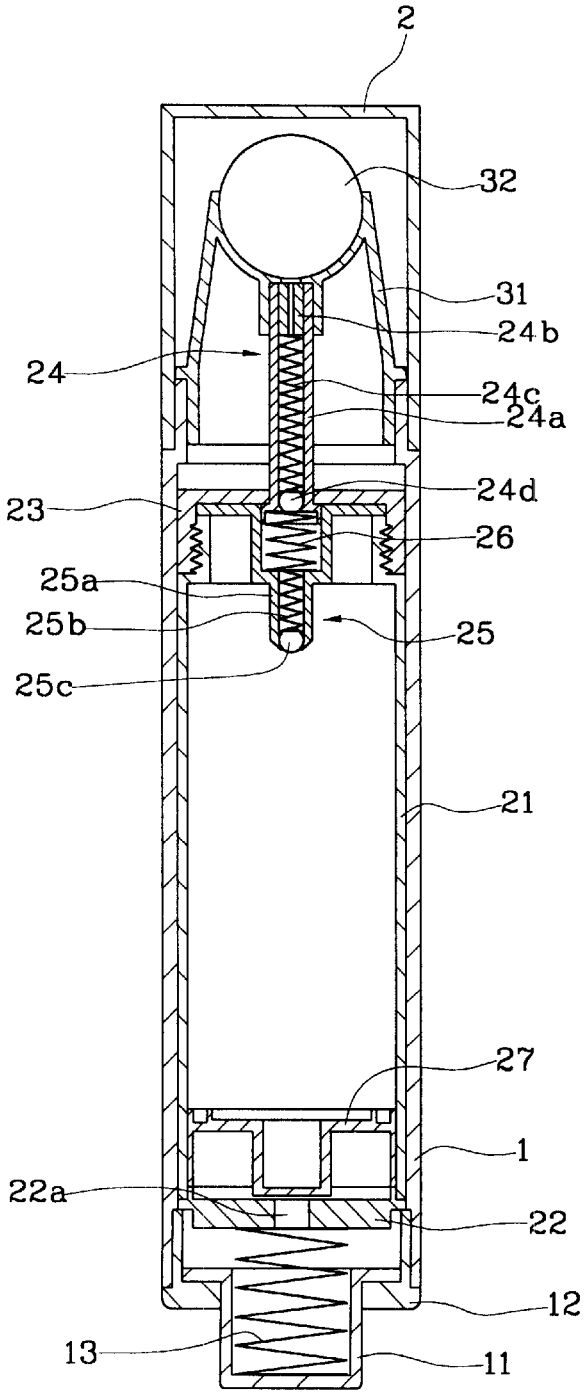
FIG. 2 illustrates a sectional view of the cosmetic article having the improved dispensing structure of FIG. 1.

FIG. 1 illustrates an exploded perspective view of a cosmetic article having an improved dispensing structure according to a first preferred embodiment of the present invention, and FIG. 2 illustrates a sectional view of the cosmetic article having the improved dispensing structure of FIG. 1.

The cosmetic article having the improved dispensing structure according to the present invention generally includes a front end part, a housing and a dispensing member. The dispensing member has a filling and dispensing part and a pressurizing part. Also, in the first preferred embodiment of the present invention shown in FIGS. 1 and 2, the dispensing member includes a from end part 30, a housing 1, a filling and dispensing part 20 and a pressurizing part 10.

The housing forms an external appearance of the cosmetic article and is in the form of a case opened at both ends. The housing is filled with liquid cosmetic product, and more specifically, is provided with the filling and dispensing part 20, which is filled with the liquid cosmetic product, inserted therein. As the result, the housing contains the liquid cosmetic product therein.

The front end part 30 is located on a front end of the housing 1 and serves to coat the liquid cosmetic product dispensed from the housing 1. In the present invention, the front end part will be a standard for dividing five embodiments, which will be described later, including the first embodiment.

In FIG. 1, the front end part 30 is located due to friction with the outside and includes a ball 32 for applying the liquid cosmetic product dispensed from the inside of the housing 1 and a front end cap 31 for mounting the ball 32 on the front end of the housing 1. Particularly, the front end cam 31 is configured to be communicated with an actuating valve 24, which will be described later, thereby serving to deliver the liquid cosmetic product discharged from the actuating valve 24 to the ball 32.

The dispensing member is mounted adjacent to a rear end of the housing 1 to dispense the liquid cosmetic product in a direction that the front end part 30 is located. In the present invention, the dispensing member includes the filling and dispensing part 29 containing the liquid cosmetic product therein and dispensing the liquid cosmetic product to the front end part by the pressure of the pressurizing part 10, and the pressurizing part 10 providing dispensing power to the filling and dispensing part 20.

The filling and dispensing part 20 includes an inner case 21, an end cap 22, a fixing valve 25, the actuating valve 24, a spring 26 and an opening cap 23.

The inner case 21 forms a body of the filling and dispensing part 20 and is in the form of a case opened at both ends to contain the liquid cosmetic product therein. Meanwhile, the inner case 21 is inserted into the inside of the housing 1 in a reciprocating manner, thereby being reciprocated by the pressure of the pressurizing part 10.

The end cap 22 is connected to an opened rear end of the inner case 21 to prevent leakage of the liquid cosmetic product, which will be contained inside the inner case 21. The end cap 22, preferably, has an end hole 22*a* formed at a central portion thereof to run inside and outside of the inner case 21. The inner case 21, preferably, has a movable member 27 therein, which is ascended and descended by pressure of the inner case 21. Functions of the end hole 22*a* and the movable member 27 will be described later in more detail.

The fixing valve 25 is disposed at an opened front end of the inner case 21 and configured to discharge or block the liquid cosmetic product contained in the inner case 21 to the front end part. More preferably, the fixing valve 25 includes a fixing valve pipe 25*a*, an opening hole 25*c* and a spring 25*b*.

The fixing valve pipe 25*a* forms a body of the fixing valve 25 and is configured to be perforated at a central portion thereof and be fixed on the front end of the inner case.

The opening hole 25*c* is located at the perforated center of the fixing valve pipe 25*a* and configured to discharge or block the liquid cosmetic product contained in the inner case 21 while reciprocating inside the fixing valve pipe 25*a*.

The spring 25*b* elastically supports the opening hole 25*c* in a rear end direction of the inner case 21 to provide a one-way restoring force to the opening hole 25*c*.

The actuating valve 24 is mounted inside the fixing valve 25, and more specifically, inside the fixing valve pipe 25*a* in a reciprocating manner so as to help to selectively discharge the liquid cosmetic product through a reciprocal action with the fixing valve pipe 25*a* under a sealed condition. More preferably, the actuating valve 24 includes an actuating valve pipe 24*a*, an opening hole 24*d* and a spring 24*c*.

The actuating valve pipe 24*a* forms a body of the actuating valve 24 and is configured to be perforated at a central portion thereof and be disposed inside the fixing valve 25, more specifically, the fixing valve pipe 25*a* in the reciprocating manner.

The opening hole 24*d* is located at the perforated center of the actuating valve pipe 24*a* and configured to be reciprocated inside the actuating valve pipe 24*a* so as to discharge or block the liquid cosmetic product entering the inside of the actuating valve 24.

The spring 24*c* elastically supports the opening hole 24*d* in a front end direction of the inner case 21 to provide the one-say restoring force to the opening hole 24*d*. At this time, the opening hole 24*d* inserted into the actuating valve pipe 24*a* and the opening hole 25*c* inserted into the fixing valve pipe 25*a* are opposite to each other in their elastically supported directions by the springs, so that when one of the opening holes functions, the other does not function. The function of the opening holes will be described later in more detail.

Meanwhile, a spring holder 24*b* is configured to fix the spring 24*c* elastically supporting the opening hole 24*d* inside the actuating valve pipe 24*a*.

The opening cap 23 mounts the actuating valve 24 and the fixing valve 25 on the opened front end of the inner case. More preferably, the opening cap 23 is screw-fit on the front end of the inner case to inject the liquid cosmetic product into the inner case 21. At this time, the screw-fit means that an outer periphery of the front end of the inner case 21 and an inner periphery of he opening cap 23 are screwed with each other so that the opening cap 23 is connected to or separated from the front end of the inner case 21 when rotating back and forth.

The pressurizing part 10 provides the one-way pressurizing power to the filling and dispensing part 20 and includes a rear end cap 12, a button 11 and a spring 13.

The rear end cap 12 is disposed at a rear end of the housing 1 to reciprocate the button 11. More preferably, the filling and dispensing part 20 is detachably connected to the rear end of the housing 1 to be inserted into or separated from the housing 1. For an embodiment, FIGS. 1 and 2 shows the first embodiment that the rear end cap 12 is forcedly connected to the rear end of the housing 1 by forcible pressure.

The button 11 is disposed at the center of the rear end cap 12 in the reciprocating manner to receive by the external force, and provides the one-way pressurizing force to the filling and dispensing part 20.

The spring 13 is interposed between the button 11 and the end cap 22 and provides the one-way restoring force to the button 11.

Hereinafter, the function of the dispensing member according to the present invention will be described in more detailed.

First, a discharge process for discharging the liquid cosmetic product to the front end will be described. When the button 11 is pressed to dispense the liquid cosmetic product, the button 11, which directly receives the external pressurizing power, advances toward the inside of the housing 1. When the button 11 advances, the filling and dispensing part 20 inserted into the housing 1 also advances toward the front end part 30 of the housing 1.

At this time, the actuating valve pipe 24*a* relatively enters the inside of the fixing valve pipe 25*a* when the filling and dispensing part 20 advances, because the actuating valve pipe 24*a* is in contact with the front end cap. Then, it causes a reduction in volume of an inner space of the fixing valve pipe 25*a*. Therefore, the opening hole 24*d* inside the actuating valve pipe 24*a* advances toward the front end of the inner case 21 and the liquid cosmetic product contained in the fixing valve pipe 25*a* is discharged in a direction that the ball 32 of the front end part 30 is located. In this process, the opening hole 25*c* inside the fixing hole pipe 25*a* is not actuated.

Next, when the button 11 is released from the external pressurizing power, the button 11 is restored into its original position by the restoring force of the spring 13 and also the filling and dispensing part 20 is restored into its original position by the restoring force of the spring 26 elastically supporting the actuating valve pipe 24*a*.

In this process, also the opening hole 24*d* of the actuating valve pipe 24*a* is restored into its original position. At this time, because the inner space of the fixing valve pipe 25*a* is expanded from a retracted state, the opening hole 25*c* inside the fixing valve pipe 25*a* advances toward the front end of the inner case 21, contrary to the opening hole 24*d* of the actuating valve pipe 24*a*. In this case, the liquid cosmetic product contained in the inner case 21 enters the fixing valve pipe 25*a*.

Meanwhile, in case that a central portion of the end cap 22 is perforated and the movable member 27 is inserted into the inner case 21, internal pressure of the inner case 21 drops due to the discharge of the liquid cosmetic product while the opening hole 24*d* of the actuating valve pipe 24*a* advances. Therefore, the movable member 27 advances toward the front end of the inner case 21 as much as an inner volume of the inner case 21 is reduced. That is, it would be appreciated that the movable member 27 is movably operated according to the inner pressure of the inner case 21 to make the dispensation of liquid cosmetic product smooth.

Hereinafter, various embodiments having various front ends designed in consideration of convenience in use or convenience of a user who puts on makeup will be described. In the following embodiments, the dispensing members are the same but the front end parts are different in shape.

Meanwhile, in the following embodiments of the dispensing members according to the present invention, the dispensing members are different from one another in shape and size according to circumstances, but the same as the first embodiment in structure and function, and therefore, detailed description of them will be omitted to avoid the repetition.

Figure 3:
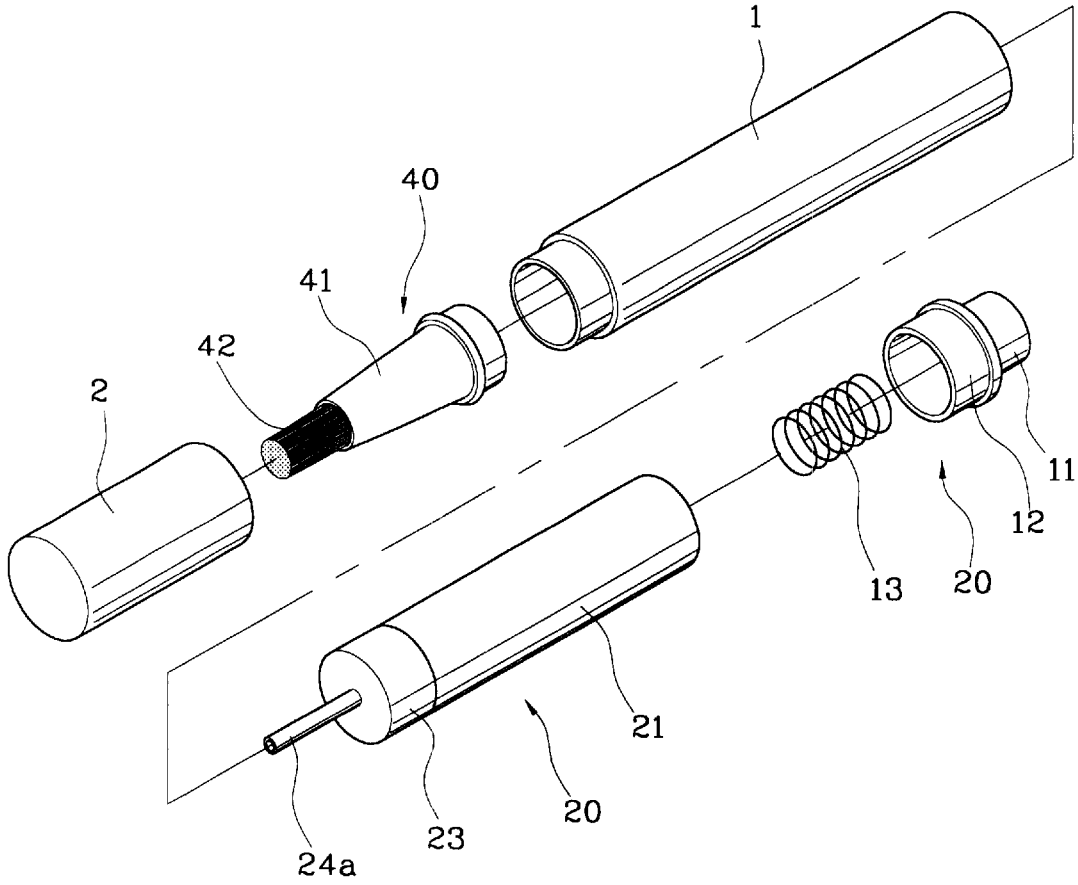
FIG. 3 illustrates an exploded perspective view of a cosmetic article having an improved dispensing structure according to a second preferred embodiment of the present invention.
Figure 4:
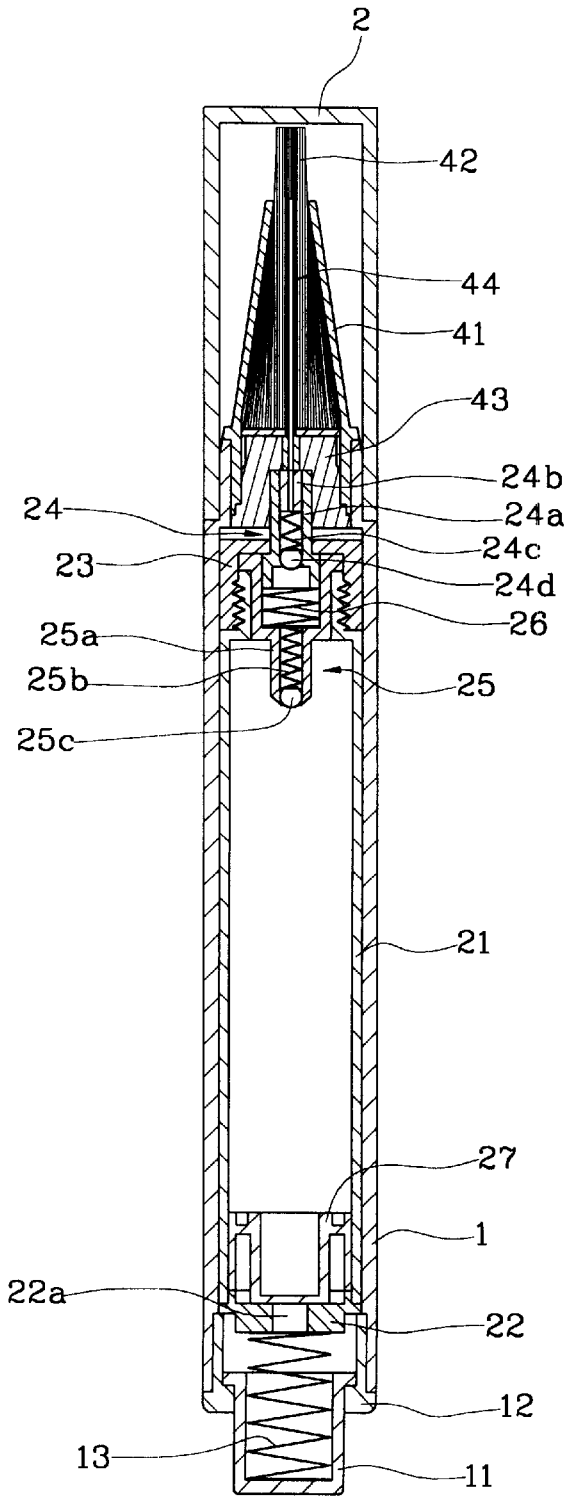
FIG. 4 illustrates a sectional view of the cosmetic article having the improved dispensing structure of FIG. 3.

FIG. 3 illustrates an exploded perspective view of a cosmetic article having an improved dispensing structure according to a second preferred embodiment of the present invention, and FIG. 4 illustrates a sectional view of the cosmetic article having the improved.dispensing structure of FIG. 3.

The second preferred embodiment shown in FIGS. 3 and 4 is provided with a brush 42, which is an applicator commonly used, disposed at a front end part 40. That is, in this embodiment, the front end part 40 includes the brush 42 and a front end cap 41.

The brush 42 consists of a bunch of soft cilia and is connected to a front end of a housing 1 through the front end cap 41. That is, when the liquid cosmetic product is dispensed from the filling and dispensing part 20, the user can conveniently apply the liquid cosmetic product with the brush 42 to the user's skin.

The front end cap 41 connects the brush 42 to the front end of the housing 1 and is communicated with an actuating valve 24 so as to serve as a path for discharging the liquid cosmetic product, which is dispensed from the filling and dispensing part 20, to the brush 42.

The front end cap 41 further includes a front end body 43 and a discharge pipe 44 therein, if necessary, during manufacture and assembly. In the drawings, the front end body 43 is fixed and connected to an end of the front end cap 41 under condition that the brush 42 is mounted inside the front end cap 41 and configured to be perforated at a central portion thereof to pass the liquid cosmetic product. The discharge pipe 44 is communicated with the perforated center of the front end body 43 and serves to guide the discharge path for discharging the liquid cosmetic product into a deeper inside of the brush 42.

Figure 5:
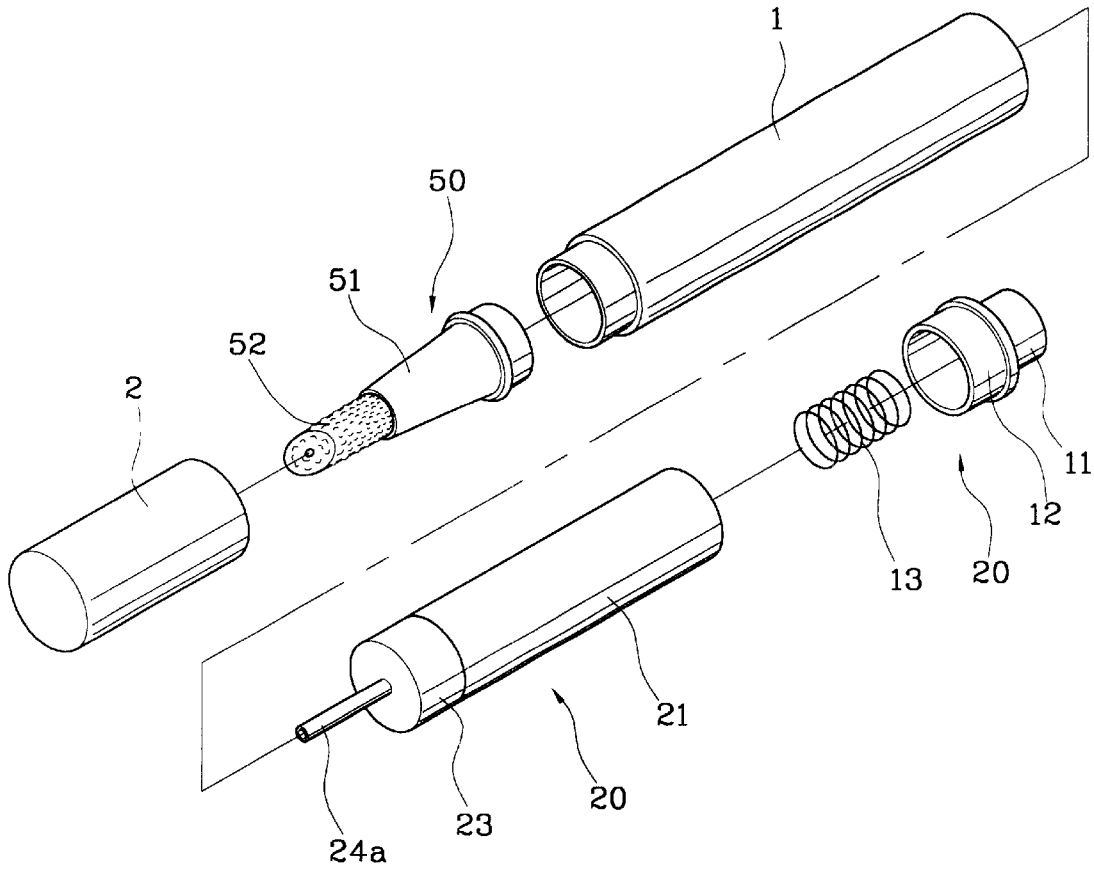
FIG. 5 illustrates an exploded perspective view of a cosmetic article having an improved dispensing structure according to a third preferred embodiment of the present invention.
Figure 6:
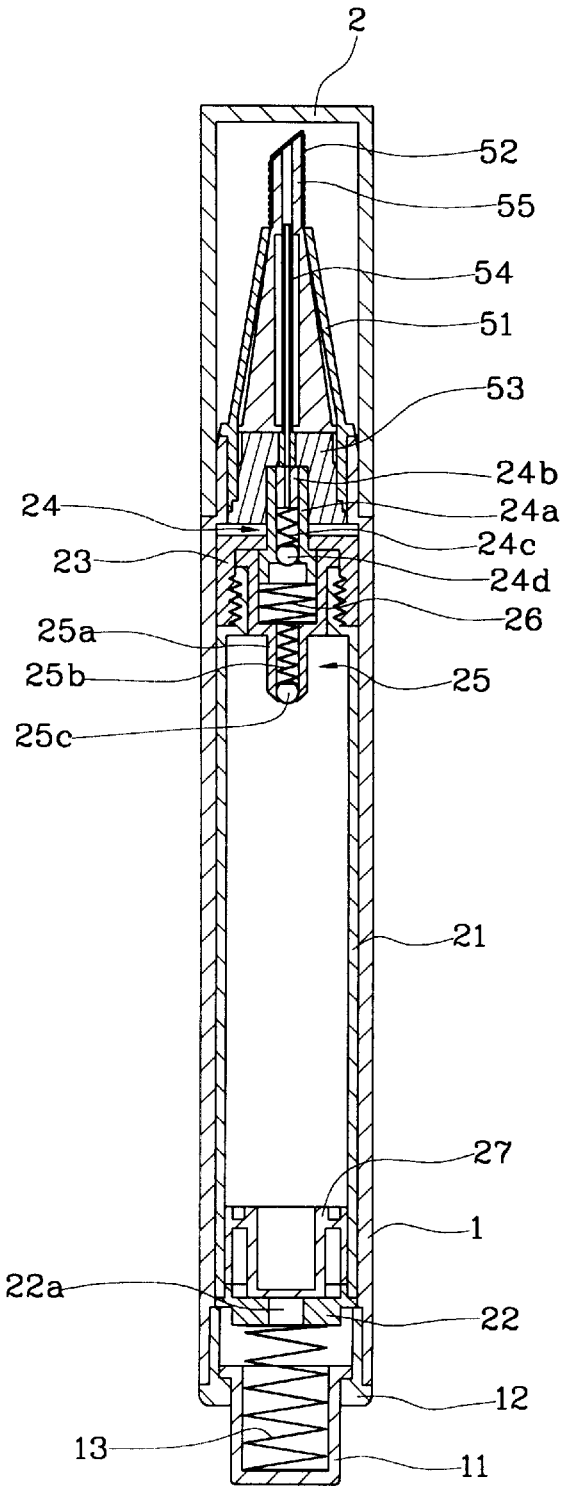
FIG. 6 illustrates a sectional view of the cosmetic article having the improved dispensing structure of FIG. 5.

FIG. 5 illustrates an exploded perspective view of a cosmetic article having an improved dispensing structure according to a third preferred embodiment of the present invention, and FIG. 6 illustrates a sectional view of the cosmetic article having the improved dispensing structure of FIG. 5.

The third embodiment shown in FIGS. 5 and 6 is provided with a brush 52 consisting of villosity, which is also an applicator commonly used as in the second embodiment, disposed at a front end part 50.

The brush 52 is coated on the outside of solid villi 52 fixed on the front end cap 51 and used for applying the liquid cosmetic product. The front end cap 51, a front end body 53 and a discharge pipe 54 will not be described as their structures and functions are the same as the second embodiment.

Figure 7:
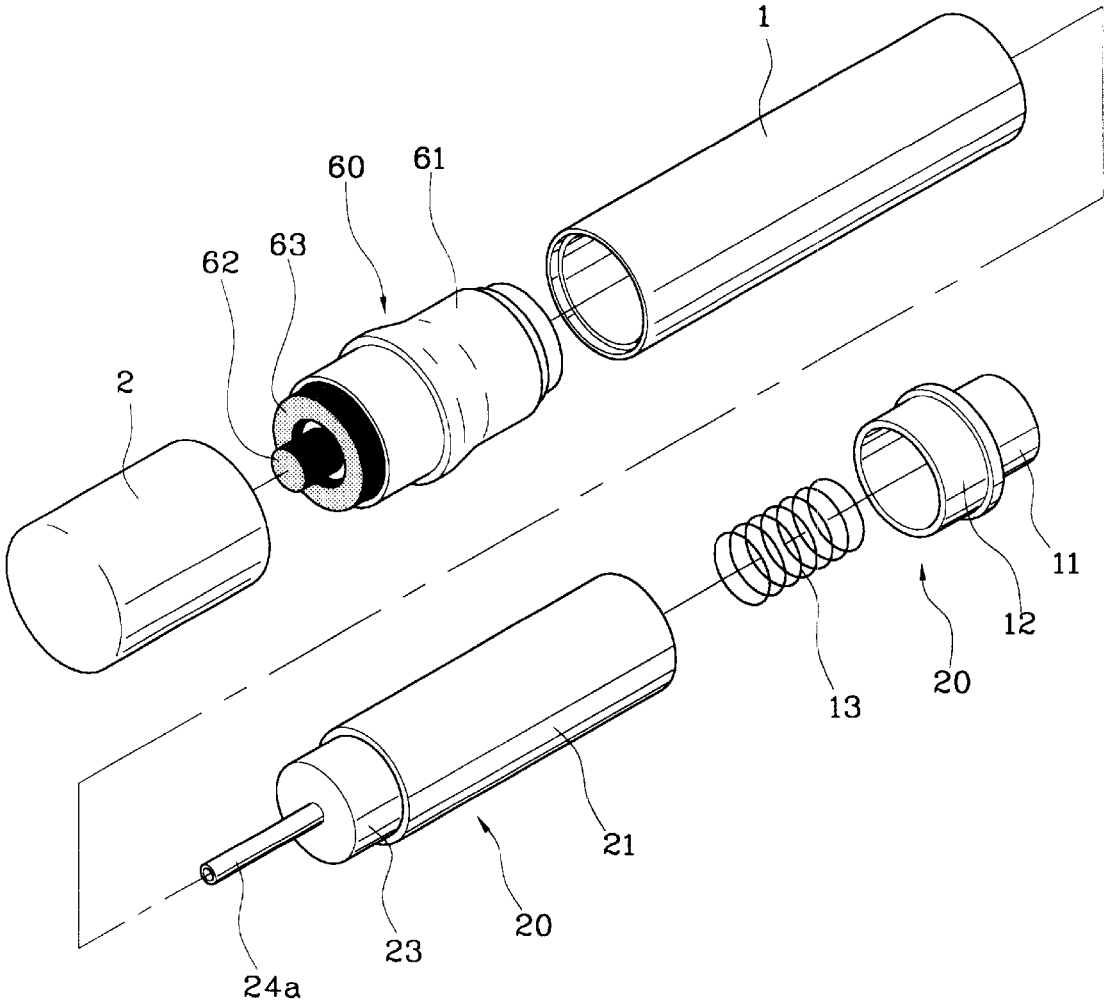
FIG. 7 illustrates an exploded perspective view of a cosmetic article having an improved dispensing structure according to a fourth preferred embodiment of the present invention.
Figure 8:
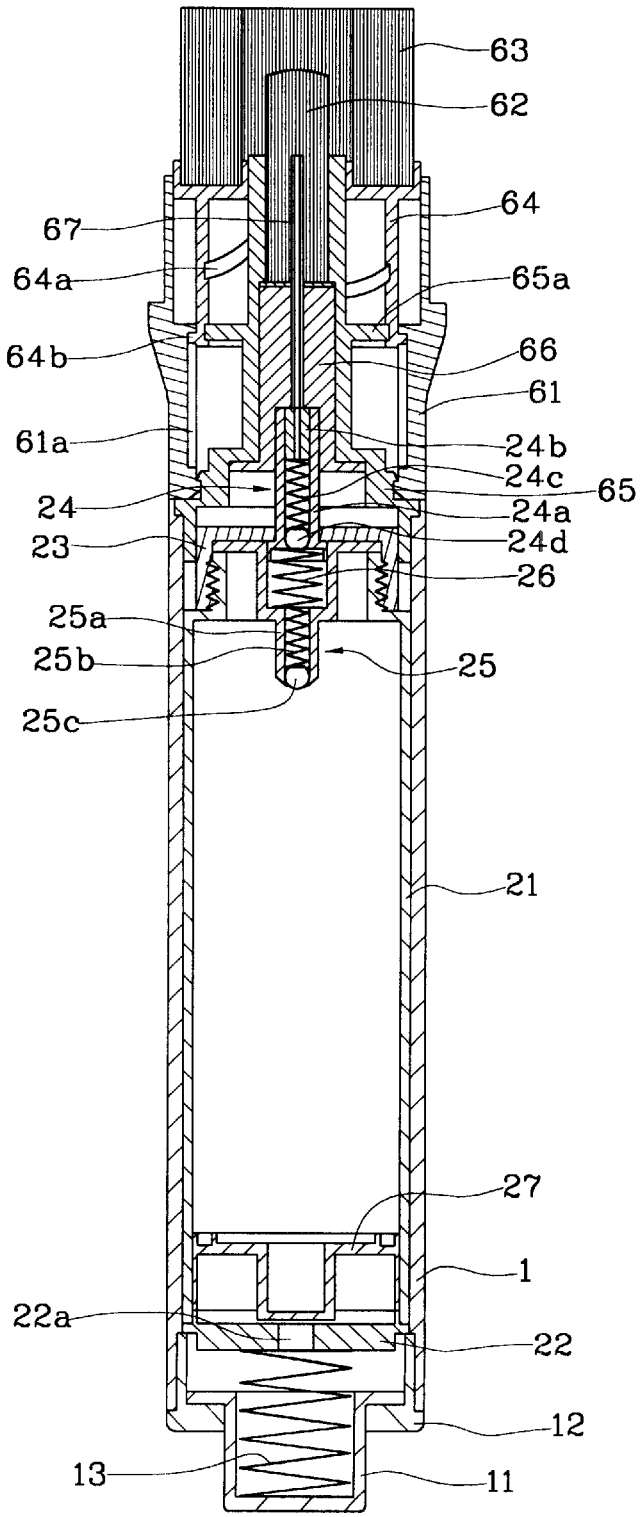
FIG. 8 illustrates a sectional view of the cosmetic article having the improved dispensing structure of FIG. 7, showing an elevated state of a holder.
Figure 9:
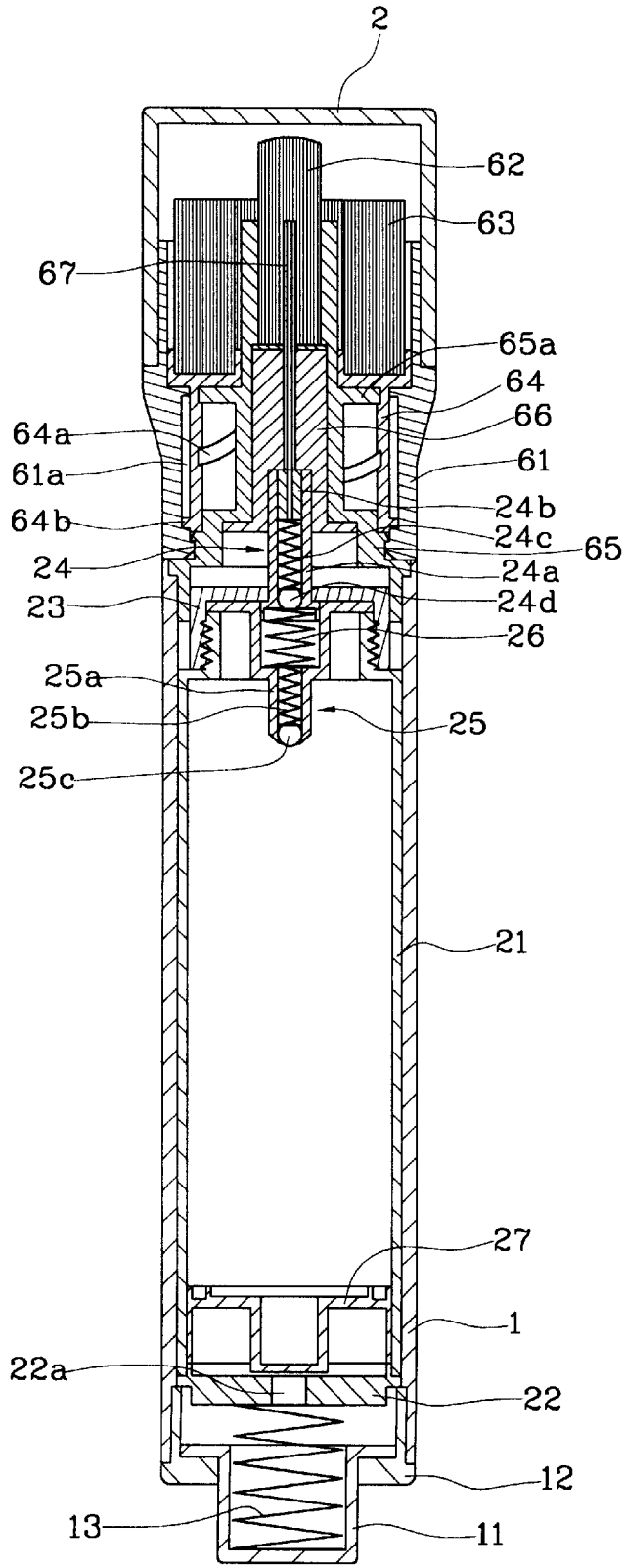
FIG. 9 illustrates a sectional view of the cosmetic article having the improved dispensing structure of FIG. 7, showing a lowered state of the holder.

FIG. 7 illustrates an exploded perspective view of a cosmetic article having an improved dispensing structure according to a fourth preferred embodiment of the present invention. FIG. 8 illustrates a sectional view of the cosmetic article having the improved dispensing structure of FIG. 7, showing an elevated state of a holder. FIG. 9 illustrates a sectional view of the cosmetic article having the improved dispensing structure of FIG. 7, showing a lowered state of the holder.

The fourth embodiment shown in FIGS. 7 through 9 is provided with two applicators disposed at a front end of the dispensing member to make various cosmetic techniques, such as heavy makeup and light makeup, possible. Particularly, the two applicators can change their positions relatively.

In this embodiment, a front end part 60 includes a fixed brush 62, a front end outer body 65, a front end body 66, an actuation brush 63, an elevation holder 64 and a front end cap 61.

The fixed brush 62 consists of a bunch of soft cilia, is fixed at a front end of a housing 1 by the front end outer body 65, and is a destination point that the liquid cosmetic product discharged from the filling and dispensing part 20 reaches finally.

The front end outer body 65 mounts the fixed brush 62 to the front end of the housing 1 and has a projection 65*a* formed on an outer periphery thereof, thereby serving to elevate the elevation holder 64 through a spiral hole 64*a* engaged with the projection 65*a*.

The front end body 66 is inserted into the front end outer body 65 to fixed the fixed brush 62 to an end of the front end outer body 65 and communicated with an actuating valve 24, thereby serving to guide the discharge path for discharging the liquid cosmetic product to the fixed brush 62. Additionally, a discharge pipe 67 may be connected to a perforated center of the front end body 66. The discharge pipe 67 serves as the discharge path for injecting the liquid cosmetic product, which is discharged from the actuating valve 24, to a deeper inside of the fixed brush 62.

The actuating brush 63 consists of a bunch of soft cilia connected to a front end of the elevation holder 64. The actuating brush 63 is an auxiliary brush disposed at the front end or the housing 1 to make various cosmetic techniques possible, besides the fixed brush 62. In this case, the user can apply the liquid cosmetic product evenly and secondarily after applying the liquid cosmetic product with the fixed brush 62.

The elevation holder 64 has the spiral hole 64*a*, which is formed on an inner periphery thereof and engaged with the projection 65*a* of the front end outer body 65, and another projection 64*b*, which is formed on the outer periphery thereof and engaged with a straight hole 61a of the front end cap 61. When the front end cap 61 receives rotary power from the outside and is rotated, the elevation holder 64 is rotated by the spiral hole 64*a* engaged with the projection of the front end outer body 65 and elevated along a direction guided by the straight hole 61*a*. It is to make a selective use of the brush possible, by changing the positions of the fixed brush 62 and the actuating brush 63 relatively.

The front end cap 61 has the straight hole 61*a*, which is formed on the inner periphery and engaged with the projection 64*b* of the elevation holder 64, and is rotatably connected to a prescribed portion of the outer periphery of the front end outer body 65. When the front end cap 61 receives the rotary power from the outside, the front end cap 61 transmits the rotary power to the elevation holder 64 and elevates the elevation holder 64.

Hereinafter, the function relating to the front end part 60 of this embodiment will be described in more detail.

First, an elevation process of the actuating brush 63 connected to the front end of the elevation holder 64 will be described. When the user rotates the front end cap 61, the front end cap 61 receives the rotary power from the outside and transmits the rotary power to the elevation holder 64 having the projection 64*b*, which is engaged with the straight hole 61*a*, through the straight hole 61*a*. The elevation holder 64 receiving the rotary power is rotated along the path guided by the spiral hole 64*a* engaged with the projection 65*a* formed on the front end outer body 65 and elevated.

Meanwhile, a descent process of the actuating brush 63 is contrary to the above. That is, when the use of the actuating brush 63 is finished, the user rotates the front end cap 61 in an opposite direction of the initial use direction, and thereby the elevation holder 64 is rotated in an opposite direction along the direction guided by the spiral hole 64*a* and descended.

Figure 10:
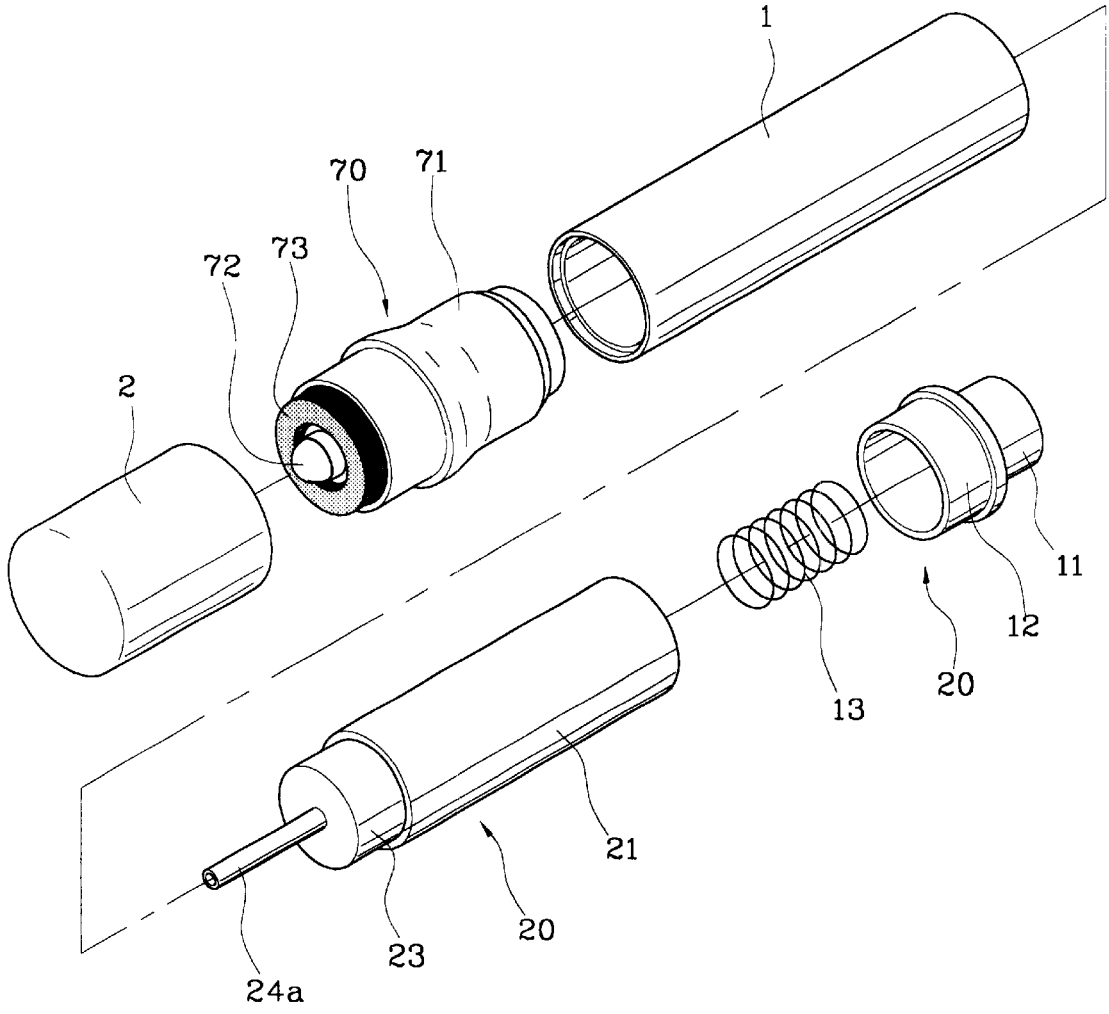
FIG. 10 illustrates an exploded perspective view of a cosmetic article having an improved dispensing structure according to a fifth preferred embodiment of the present invention.
Figure 11:
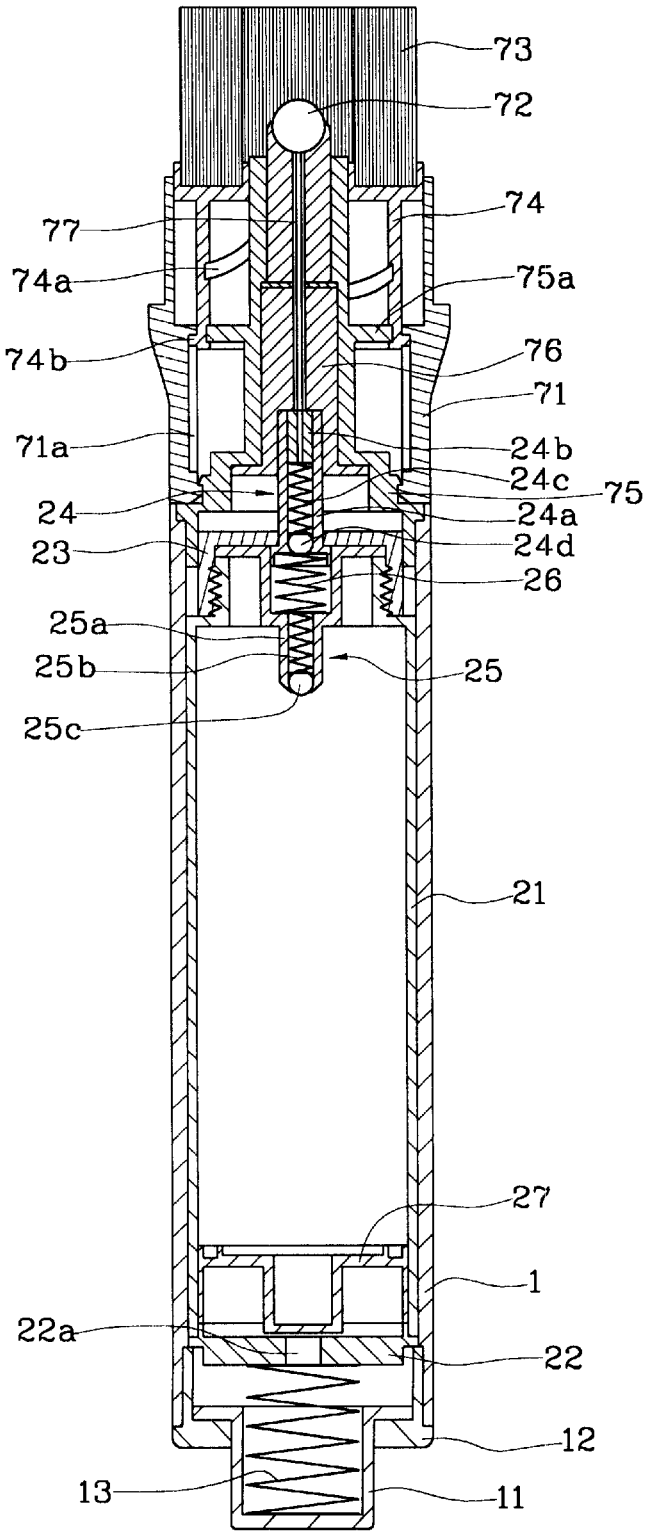
FIG. 11 illustrates a sectional view of the cosmetic article having the improved dispensing structure of FIG. 10, showing an elevated state of a holder.
Figure 12:
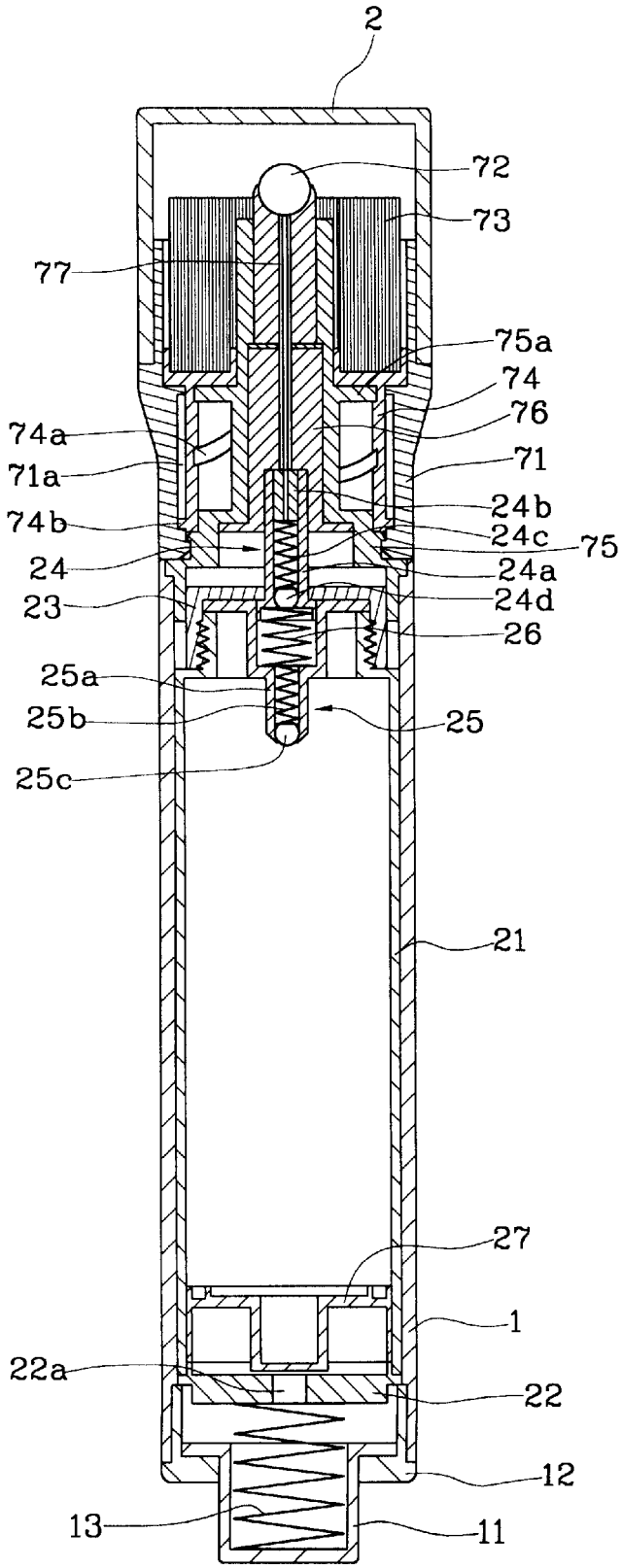
FIG. 12 illustrates a sectional view of the cosmetic article having the improved dispensing structure of FIG. 10, showing a lowered state of the holder.

FIG. 10 illustrates an exploded perspective view of a cosmetic article having an improved dispensing structure according to a fifth preferred embodiment of the present invention. FIG. 11 illustrates a sectional view of the cosmetic article having the improved dispensing structure of FIG. 10, showing an elevated state of a holder. FIG. 12 illustrates a sectional view of the cosmetic article having the improved dispensing structure of FIG. 10, showing a lowered state of the holder.

The fifth embodiment shown in FIGS. 10 through 12 is provided with a ball 72 for applying the liquid cosmetic product dispensed from the filling and dispensing part through rotation due to friction with the outside, instead of the fixed brush 62 of the fourth embodiment.

The fifth embodiment includes a front end outer case 75, a front end body 76, an actuating brush 73, an elevation holder 74 and a front end cap 71, but their detailed description will be omitted as being the same as the fourth embodiment.

Therefore, the present invention can substantially reduce the number of required components and a manufacturing cost by the filling and dispensing part, which can carry out both filling and dispensation of the liquid cosmetic product. Furthermore, the present invention can provide a reliable sealing trough a combined structure and make the dispensation of the liquid cosmetic product even and smooth.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A cosmetic article having an improved dispensing structure, the cosmetic article comprising a housing being in the form of a case opened at both ends and filled with liquid cosmetic product, a front end part disposed at a front end of the housing to apply the liquid cosmetic product discharged from the housing, and a dispensing member disposed at a rear end of the housing to dispense the liquid cosmetic product to the front end part, wherein the dispensing member includes:

a filling and dispensing part having an inner case being in the form of a case opened at both ends, containing the liquid cosmetic products therein and inserted into the housing in a reciprocating manner, an end cap connected to an opened rear end of the inner case, a fixed valve disposed at an opened front end of the inner case, an actuating valve disposed inside the fixed valve in a reciprocating manner, a spring elastically supporting the actuating valve to be reciprocated inside the fixed valve, and an opening cap for mounting the actuating valve and the fixed valve at the opened front end of the inner case; and a pressurizing part having a rear end cap disposed at the rear end of the housing, a button disposed at a central portion of the rear end cap in a reciprocating manner, and a spring interposed between the button and the end cap.

2. The cosmetic article of claim 1, wherein the fixed valve includes: a fixed valve pipe perforated at a central portion thereof and fixed at the front end of the inner case; an opening hole located at the perforated center of the fixed valve pipe to discharge and block the liquid cosmetic product inside the inner case; and a spring elastically supporting the opening hole in a rear end direction of the inner case.

3. The cosmetic article of claim 1, wherein the actuating valve includes: an actuating valve pipe perforated at a central portion thereof and disposed inside the fixed valve in a reciprocating manner; an opening hole located at the perforated center of the actuating valve pipe to discharge and block the liquid cosmetic product inside the fixed valve; and a spring elastically supporting the opening hole in a front end direction of the inner case.

4. The cosmetic article of claim 1, wherein the end cap includes an end hole perforating a central portion thereof and the inner case includes a movable member mounted therein and elevated according to pressure of the inner case.

5. The cosmetic article of claim 1, wherein the opening cap is screwed to the front end of the inner case to inject the liquid cosmetic product into the inner case at any time.

6. The cosmetic article of claim 1, wherein the front end part includes: a ball rotated due to friction with the outside; and a front end cap for mounting the ball at the front end of the housing, the front end cap communicating with the actuating valve to dispense the liquid cosmetic product through the ball.

7. The cosmetic article of claim 1, wherein the front end part includes: a brush consisting of a bunch of cilia; and a front end cap for mounting the brush at the front end of the housing, the front end cap communicating with the actuating valve to dispense the liquid cosmetic product to the brush.

8. The cosmetic article of claim 1, wherein the front end part includes: a brush formed by coating villosity on the outside of solid villi; and a front end cap for mounting the brush at the front end of the housing, the front end cap communicating with the actuating valve to dispense the liquid cosmetic product to the brush.

9. The cosmetic article of claim 1, wherein the front end part includes: a fixed brush consisting of a bunch of cilia; a front end outer body mounting the brush to the front end of the housing and having a projection formed on an outer periphery thereof; a front end body inserted inside the front end outer body to fix the brush to an end of the front end outer body, the front end body communicating with the actuating valve to discharge the liquid cosmetic product to the brush; an elevation holder having a spiral hole formed on an inner periphery thereof, a projection formed on an outer periphery thereof and an actuating brush disposed at a front end thereof, the spiral hole being engaged with the projection of the front end outer body; and a front end cap having a straight hole formed on an inner periphery thereof for engaging the projection of the elevation holder, the front end cap being rotatably connected to the outer periphery of the front end outer body.

10. The cosmetic article of claim 1, wherein the front end part includes: a ball rotated due to friction with the outside; a front end outer body rotatably mounting the ball to the front end of the housing and having a projection formed on an outer periphery thereof; a front end body inserted inside the front end outer body to fix the brush to an end of the front end outer body, the front end body communicating with the actuating valve to discharge the liquid cosmetic product to the brush; an elevation holder having a spiral hole formed on an inner periphery thereof, a projection formed on an outer periphery thereof and an actuating brush disposed at a front end thereof, the spiral hole being engaged with the projection of the front end outer body; and a front end cap having a straight hole formed on an inner periphery thereof for engaging the projection of the elevation holder, the front end cap being rotatably connected to the outer periphery of the front end outer body.

* * * * *